United States Patent [19]

James

[11] Patent Number: 4,633,538

[45] Date of Patent: Jan. 6, 1987

[54] INVALID HOIST

[75] Inventor: David R. James, Glenyard, England

[73] Assignee: James Industries Limited, Gloucester, England

[21] Appl. No.: 700,513

[22] Filed: Feb. 11, 1985

[30] Foreign Application Priority Data

Feb. 14, 1984 [GB] United Kingdom ..... 8403788

[51] Int. Cl.[4] ..... A61G 7/10

[52] U.S. Cl. ..... 5/86; 5/81 B; 187/9 R; 414/921

[58] Field of Search ..... 5/81 R, 83–88, 5/81 B, 81 C; 192/81 C, 41 S; 74/89.15; 464/40, 57, 73; 187/92, 24, 25; 414/921; 414/921; 280/47, 38

[56] References Cited

U.S. PATENT DOCUMENTS

| | | | |
|---|---|---|---|
| 1,472,782 | 11/1923 | Barber | 464/57 |
| 2,846,091 | 8/1958 | Heffner | 414/550 |
| 2,899,808 | 8/1959 | Berens | 464/73 |
| 2,962,730 | 12/1960 | Carnes et al. | 5/86 |
| 3,396,556 | 8/1968 | Giegrich | 464/73 |
| 3,798,984 | 3/1974 | McMinn | 74/89.15 |
| 3,940,808 | 3/1976 | Petrini | 5/86 |
| 3,981,484 | 9/1976 | James | 5/81 R |
| 3,998,284 | 12/1976 | James | 5/86 |
| 4,172,369 | 10/1979 | Hayes | 464/73 |
| 4,232,412 | 11/1980 | Petrini | 5/86 |
| 4,324,317 | 4/1982 | Winkelblech | 187/25 |
| 4,353,436 | 10/1982 | Rice et al. | 187/9 R |

FOREIGN PATENT DOCUMENTS

| | | | |
|---|---|---|---|
| 1219651 | 6/1966 | Fed. Rep. of Germany | 187/9 R |
| 134017 | 8/1982 | Japan | 192/81 C |

*Primary Examiner*—John E. Murtagh
*Assistant Examiner*—Andrew Joseph Rudy
*Attorney, Agent, or Firm*—Collard, Roe & Galgano

[57] ABSTRACT

An invalid hoist comprises a base having a column support socket, an upstanding column detachably mounted in said socket and a lifting arm extending from the column. Said arm is movable along the column by a screw-and-nut lifting mechanism within the column, with the nut of said mechanism being coupled to the arm. A reversible electric motor unit and battery for energization of the motor are mounted on said base with an output shaft of a reduction gear box of the motor unit aligned with and directly coupled to the lower end of the screw of said lifting mechanism to provide a drive from the motor to the screw, through the socket. The drive between said output shaft and said screw is provided by a coupling which can readily be broken to enable the column to be detached from the base without disturbing the motor.

19 Claims, 7 Drawing Figures

FIG. 6.

INVALID HOIST

BACKGROUND OF THE INVENTION

1. Field of the Invention

This invention relates to invalid hoists, the term "invalid" being used herein to include hospital patients and disabled persons generally. It is particularly concerned with hoists comprising an upstanding column from which a lifting arm projects and which is mounted on a base. The lifting arm is raised and lowered by a lifting mechanism within the column and an invalid support member is supported at the end of the arm.

2. Description of Prior Art

Hoists of the foregoing character are known with a manual drive for the lifting mechanism connected to the upper end of a lifting screw of the mechanism at the top of the column. For transport and storage purposes it is desirable that the column should be detachable from the base. In order to provide a power-operated hoist it has been proposed to replace the manual drive at the top of the column by an electric motor unit, a battery by which the motor is energized being mounted on the base. The result is a hoist with a column which is not readily made detachable, partly because of the increased weight of the column which includes the motor unit and also because of the need to provide heavy duty power cables connecting the battery on the chassis to the motor at the top of the column. A further disadvantage is that the motor unit represents additional top weight which should be avoided so far as possible, particularly with a mobile hoist, in the interests of stability.

SUMMARY OF THE INVENTION

The object of the invention is to provide a power-operated invalid hoist which has a readily detachable column and which overcomes the foregoing disadvantages.

According to the invention an invalid hoist comprises a base having a column support socket or hollow column support spigot, an upstanding column detachably mounted in the socket or on the spigot, a lifting arm extending from the column and movable therealong by a screw-and-nut lifting mechanism within the column and the nut of which is coupled to the arm, a reversible electric motor unit and a battery for energization of the motor mounted on the base with an output shaft of the motor unit aligned with and directly coupled to the lower end of the screw of said lifting mechanism to provide a drive from the motor to the screw, through the socket or spigot, by a drive coupling which can readily be broken to enable the column to be detached from the base without disturbing the motor unit.

Thus the invention provides a power-operated invalid hoist with a column which is not only readily detachable but which can be lighter than an equivalent manually-operated hoist, by reason of the omission of the weight of the manual drive means on the column. The invention factor provides special advantages with a mobile hoist when said base comprises a mobile chassis.

Preferably the coupling is positioned within the support socket or spigot and employs dog or spline-like engagement such that it can readily be made and broken, by axial separation of coupling elements respectively secured to the lower end of the screw and to said output shaft, without the use of tools. An upper end bearing for the screw of said mechanism preferably incorporates an axial thrust bearing assembly which supports the weight of the lifting mechanism, the lifting arm and the weight supported by the arm including that of the invalid being lifted, whereby said output shaft of the motor unit shaft is relieved of axial loading.

The arm preferably projects through a longitudinal slot at the front side of the column and may be attached to a wheeled carriage which runs inside the column so that the weight supported by the hoist does not apply a bending moment to the screw. The nut may be embodied in a nut/clutch unit fixed to the bottom of the carriage, the clutch of this unit operating rotationally to couple the nut to the carriage during raising movement thereof but allowing the nut to turn relatively to the carriage, on a low-friction bearing, and thus to turn with the screw in the event that lowering movement of the arm is obstructed. Such obstruction may occur, for example, when the hoist is used for bathing purposes and the arm is lowered into contact with the rim of the bath tub or an invalid support member fixed to the lifting arm reaches the bottom of the bath tub.

The column is preferably formed of rectangular section steel tube, with larger diameter wheels of the carriage engaging the front and rear walls of the column which thus provide tracks along which the carriage is guided between the other side walls of the column.

The chassis may be of U-shape open at the front and with a rear cross member on which the mounting socket or spigot is centrally mounted with the motor unit underslung with respect to the cross member. The cross member is preferably of hollow box section which provides a housing for the battery which is conveniently one of two batteries respectively mounted adjacent the two ends of the cross member.

A motor control circuit may include operating relays respectively controlling the lifting and lowering rotation of the reversible motor, and an upper limit switch mounted on the base may be operative to limit the powered traveller of the arm. Preferably said relays operate to short circuit the motor and thus apply regenerative braking to the lifting screw at the end of each raising or lowering movement.

Other features of the invention will be apparent from the following description, drawings and claims, the scope of the invention not being limited to the drawings themselves as the drawings are only for the purpose of illustrating ways in which the principles of the invention can be applied. Other embodiments of the invention utilizing the same or equivalent principles may be made as desired by those skilled in the art without departing from the present invention and the purview of the appended claims.

BRIEF DESCRIPTION OF THE INVENTION

DESCRIPTION OF THE PREFERRED EMBODIMENT

Figure 1:
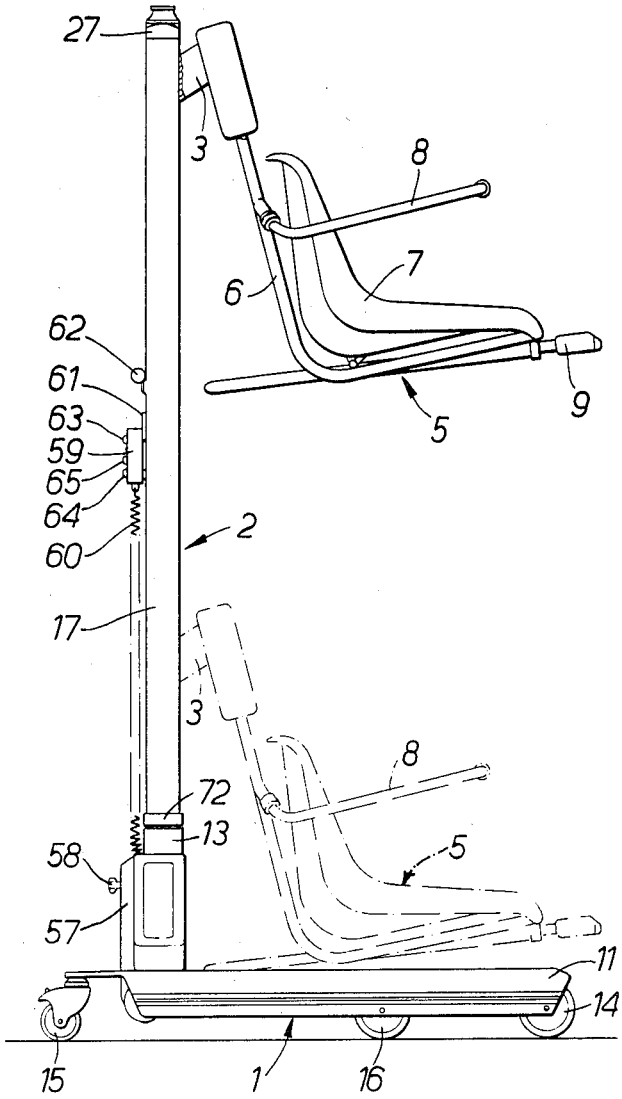
FIG. 1 is a somewhat diagrammatic side view of a hoist in accordance with the invention.
Figure 2:
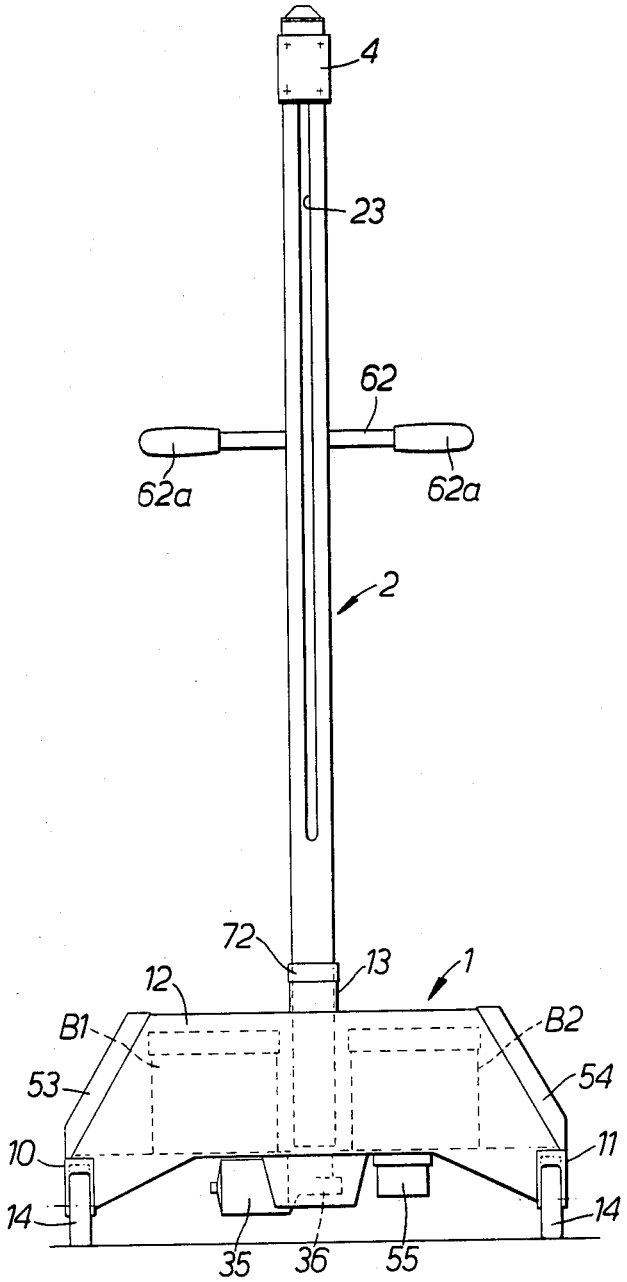
FIG. 2 is a corresponding front view, with a patient support seat removed.
Figure 3:
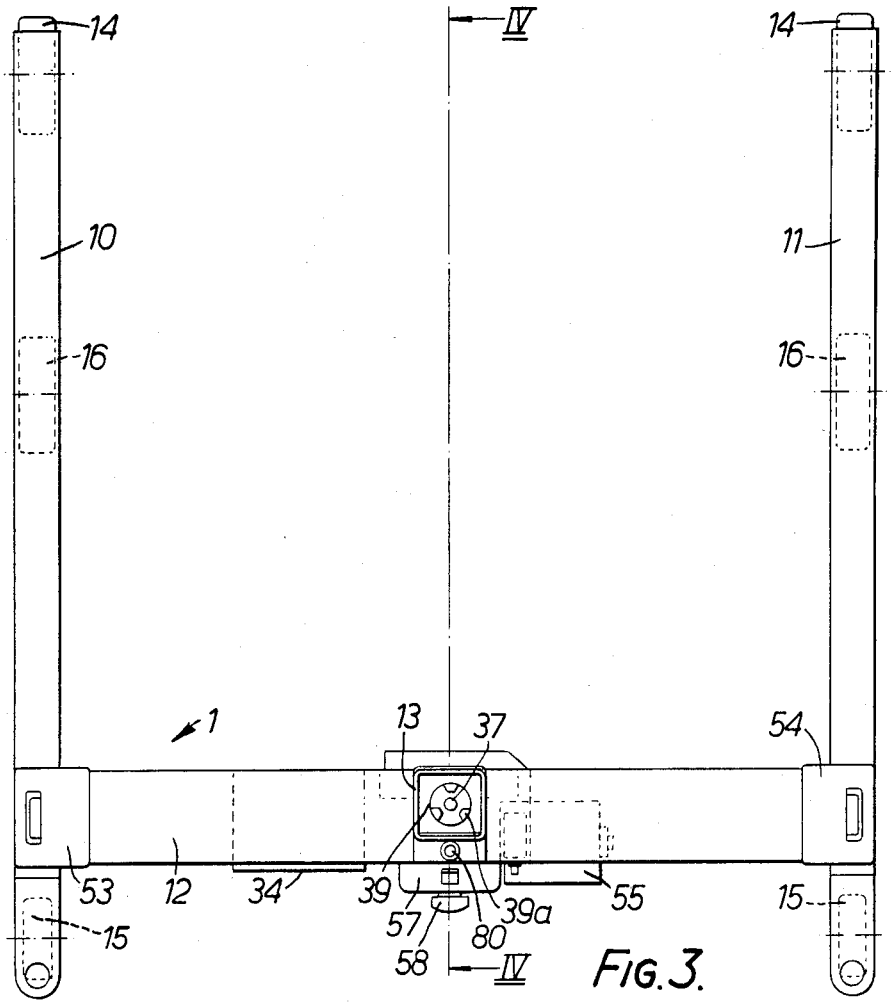
FIG. 3 is a plan view of a mobile chassis base of the hoist.

The power-operated invalid hoist illustrated in the drawings comprises a mobile chassis 1 supporting an upstanding and readily detachable column 2 from which a lifting arm 3 (see FIG. 5) projects. A mounting flange 4 at the outer end of the short cantilever arm 3 enables any selected one of a range of invalid support members to be secured to the arm 3 by means of bolts 4*a*. In FIG. 1 there is illustrated a support member 5 in the form of a legless chair.

The support member 5 shown comprising a tubular steel frame 6 detachably secured to the flange 4 and supporting a molded seat member 7. The frame 6 incorporates pivotally mounted arm rests 8, and a telescopically extendable leg-rest 9 shown in the retracted position. Alternative forms of support member include, for example, one of stretcher-like form.

Figure 4:
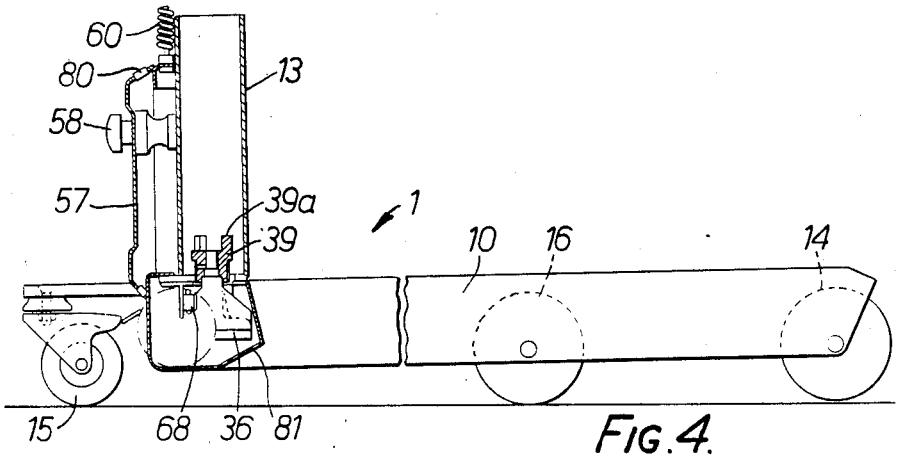
FIG. 4 is a cross-sectional view of the chassis on the line iv—iv in FIG. 3.

The mobile chassis 1 is of open-fronted U-shape with side members 10 and 11 interconnected by a rear cross member 12 which is of hollow box section. A square-section support socket 13 positioned centrally on the cross member 12 projects above and extends throughout the depth of the cross member 12, and detachably supports the column 2. Mobility of the chassis 1 is provided by fixed-axis wheels 14 mounted at the front ends of the side members 10 and 11, castor wheels 15 mounted at the rear ends thereof, and intermediate fixed-axis wheels 16. The intermediate wheels 16 are positioned a short distance forwardly of the center of gravity of the hoist with a patient seated on the support member 5. As a result the chassis 1 normally rests on the wheels 15 and 16, as shown in FIG. 4, with the front wheels a small distance off the ground. This provides the maneuverability of a short wheelbase chassis, with the stabilty of a long wheelbase chassis as the latter can rock forwards on the intermediate wheels 16 to bring about ground contact of the front wheels 14. This happens, for example, if the wheels are impeded as the hoist is being pushed forwards and thus tends to tip forwardly.

Figure 5:
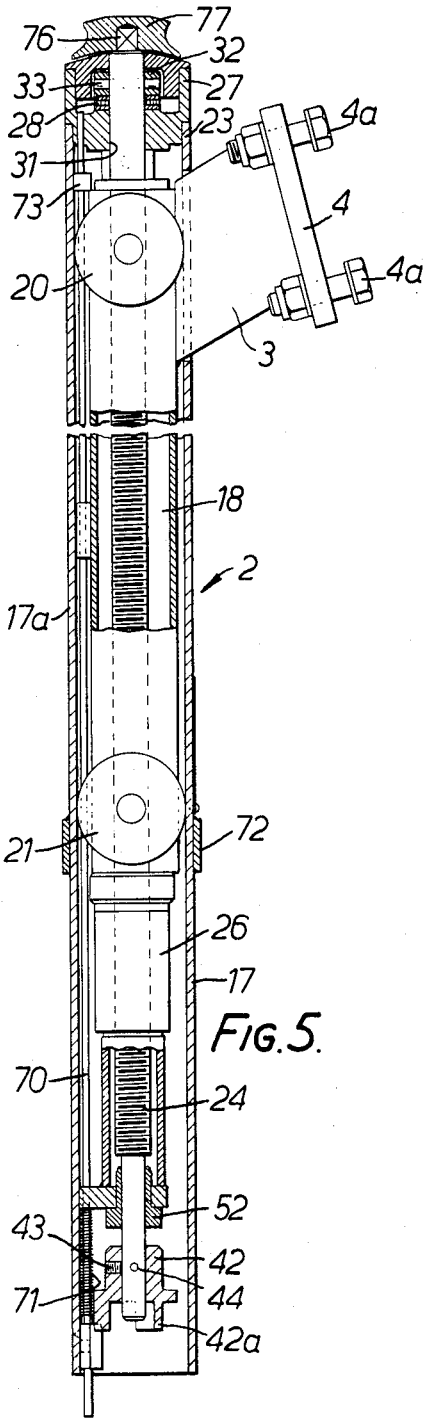
FIG. 5 is a cross-section view of a column of the hoist, mainly taken in the same plane as FIG. 4 but with the central portion in a plane laterally offset therefrom.
Figure 6:
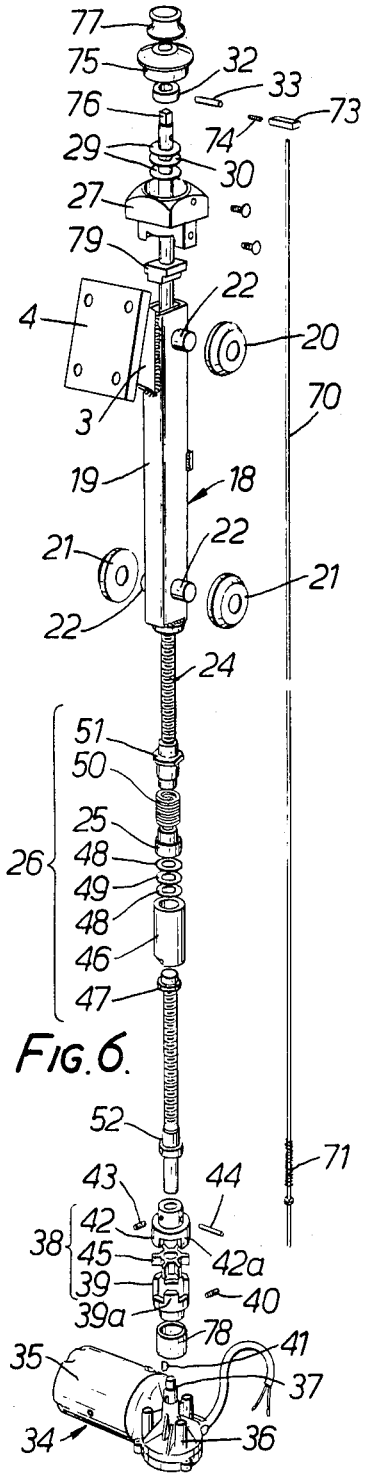
FIG. 6 is an exploded view of the internal components of the column.

The column 2, which is slightly backwardly inclined as shown in FIG. 1, is shown in sectional view in FIG. 5 and comprises a square-section steel tube 17 which fits into the mounting socket 13. A wheeled carriage 18 (see particularly FIG. 6) which runs within the column 2 comprises a short length of rectangular-section steel tube 19 with upper and lower guide wheels 20 and 21 which turn freely on pairs of opposed projecting stub axles 22. The upper wheels 20 run on the front wall 17*a* of the tube and the lower wheels 21 run on the rear wall 17*b* thereof. The arm 3, which projects through a central longitudinal slot 23 in the front wall 17*a*, is rigidly attached at the upper end of the carriage 18.

A one-piece lifting screw 24 is engaged by a nut 25 embodied in a nut/clutch unit 26 extends along the column axis and is suspended at its upper end by a bearing arrangement comprising a molded plastic housing 27 fitted within the top end of the column tube 17 and within which is positioned a thrust bearing 28 comprising upper and lower bearing races 29 and a caged bearing ball assembly 30. The base of the housing 27 has a central bore 31 which closely receives and radially locates a plain upper end portion of the screw 24. The upper bearing race 29 supports the weight of the lifting mechanism, the arm 3, the patient support member 5 and the patient through a collar 32 fixed on to the screw 24 by a cross pin 33, which collar 32 rests on the upper race 29. The screw 24 is driven to raise or lower the carriage 18, with the arm 3, by means of a motor unit 34 which is underslung with respect to the cross member 12. This unit comprises a horizontally disposed reversible electric motor 35 and an integral reduction gear box 36 with an output shaft 37. The output shaft 37 is detachably coupled to the lower end of the screw 24 by a coupling 38 which is readily made or broken by insertion of the column 2 into, or removal of the column 2 from, the socket 13.

The coupling 38 comprises a lower coupling element 39, mounted on the shaft 37 and secured thereto by a setscrew 40 and key 41, and an upper coupling element 42 mounted on the lower end of the screw 24 and secured thereto by a setscrew 43 and cross pin 44. The coupling members 39 and 42 are identical with three axially projecting dogs such as 39*a* and 42*a*, with the two sets of dogs 39*a* and 42*a* being interdigitated and respectively engaging the spaces between the arms of an intermediate spider element 45. The element 45 is molded from a resilient material to provide a cushioned drive.

The carriage 18 rests on the nut/clutch unit 26 so that it is directly lifted by the latter during raising movement of the hoist. The unit 26 comprises a housing 46 with a lower end bearing bush 47 through which the screw passes and which contains, in order above the bush 47, a low-friction bearing comprising races 48 and a caged ring of bearing balls 49, the lifting nut 25, a helical clutch spring 50 and a clutch member 51 with an intermediate flange which is free to turn on the screw 24. The clutch member 51 is fixed in the top of the housing and is secured to the bottom of the carriage 18. During raising movement the clutch spring 50 tends to tighten its grip on the nut 25 and the clutch member 51, so that these components are firmly clutched and the nut 25 cannot turn relatively to the carriage and the latter undergoes positive raising movement. During normal lowering movement, which is assisted by gravity, the clutch spring 50 grips the nut 25 and the clutch member 51 so that the nut 25 does not turn relative to the carriage 18 which is thus lowered at a rate determined by the speed of rotation of the screw 24. However, in the event that the carriage 18 is not free to move downwards the clutch spring 50 loosens and allows the nut 25 to turn freely with the screw 24 within the housing 46 on the low-friction thrust bearing 48,49. Thus substantially no downward force is applied to the carriage 18 by the lifting mechanism if the motor 35 continues rotating. The lower end of the screw 24 is radially located by a fixed bush 52.

The electric motor 35 is energized by two rechargeable batteries B1 and B2 housed within the hollow cross member 12 on opposite sides of the socket 13. The ends of the cross member 12 are closed by removable end covers 53 and 54, and a battery charger 55 is mounted below the cross member 12. A mains lead 56 with plug (see FIG. 7), for connection of the charger 55 to the mains electricity supply is housed, when not in use, beneath a hinged cover 57 at the rear of the cross member 12 and this cover is held in the closed position by a handscrew 58. The electrical control circuit of the hoist includes a hand-held RAISE/LOWER:ON/OFF switch unit 59 connected to the remainder of the circuit through a flexible lead 60. This unit 59 has a bracket 61 which can be hooked on to a projection at the rear of the column 2, as shown in FIG. 1, immediately below a lateral handlebar 62 with end handgrips 62*a* by which the hoist can be manually propelled and maneuvered. The unit embodies pushbutton RAISE, LOWER and OFF switches 63, 64 and 65 and it can be used mounted on the column 2, as in FIG. 1, or unhooked therefrom and operated held in the hand.

Figure 7:
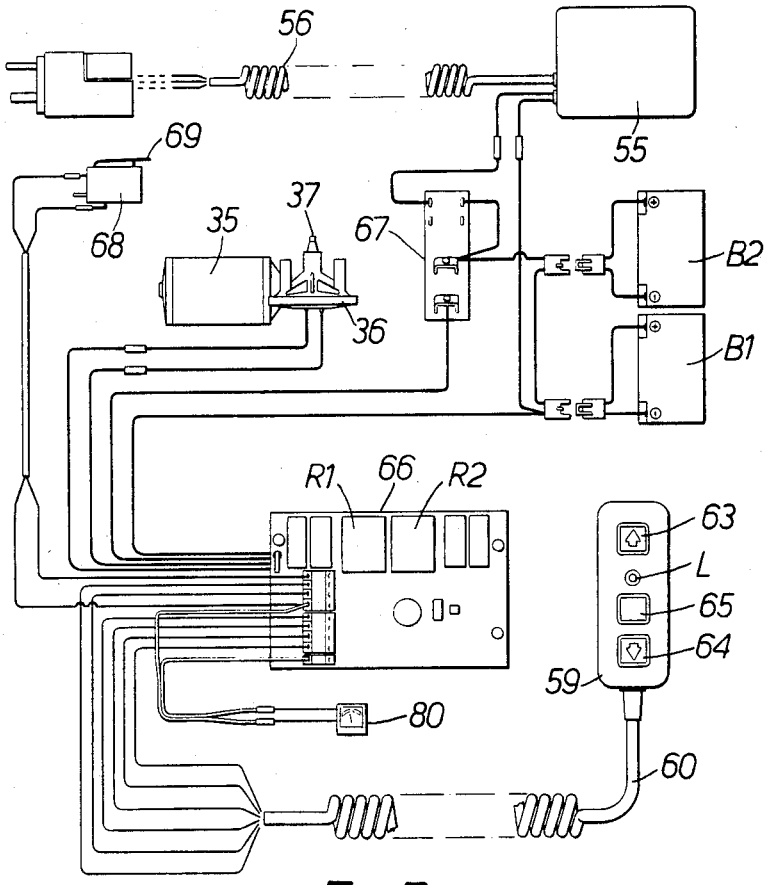
FIG. 7 is a control circuit diagram.

Referring to the circuit diagram of FIG. 7, the RAISE and LOWER switches 63 and 63 when closed respectively energized RAISE and LOWER relays R1 and R2 mounted on a PCB 66. The two 12 volt rechargeable batteries B1 and B2 circuit in series, and the latching ON/OFF switch 65 isolates the relay circuits when the hoist is not in use. The ON condition is indicated by an indicator light L. The relays R1 and R2 when energized respectively operate to connect the motor 35 to the batteries B1 and B2 according to the direction of motor rotation required. When the relays are de-energized the motor 35 is short circuited to provide regenerative braking of the motor 35 at the end of each raising or lowering movement of the arm 3, thereby absorbing the kinetic energy of the motor 35 with rapid cessation of movement. A pushbutton isolator switch 67, mounted on the cover 57, when actuated isolates the motor control circuit from the batteries B1 and B2 and connects the latter to the charger 55. Thus when the hoist is not in use the batteries can be charged by connecting the lead 56 to the mains electricity supply.

An upper limit switch 68 which is normally closed is actuated to de-energized the relay R1 when the carriage 18 reaches a predetermined upper limit of its travel. This switch 68 has an actuator 69 and it is mounted immediately below the socket 13 as shown in FIG. 4, and the actuator 69 is engaged by an actuating rod 70 slidably mounted within the column 2. The rod 70 is urged downwardly by a spring 71 so that during normal operation the rod 70 depresses the actuator 69 to close the contacts of the switch 68. At said upper limit of carriage movement the upper end of the carriage 18 engages a projecting arm 73 in the form of a plate secured to the actuating rod 70 by a setscrew 74. Such engagement displaces the rod 70 upwardly against the spring 71, thereby releasing the actuator 69 and allowing the contacts of switch 68 to open thus de-energising relay R1.

The upper end of the lifting screw 24 projects through a closure cap 75 secured to the top of the bearing housing 27. At its upper end the screw 24 has a square section 76 which enables a detachable winding handle (not shown) to be fitted to the screw 24 for manual operation of the hoist in the event of an electrical failure. During normal electrical operation a rubber end cap 77 fits over the upper end of the screw 24 and can be removed should manual operation be necessary.

Although a lower limit switch could be provided if desired, this is not necessary as if the carriage 18 reaches the lower limit of its travel the clutch of the unit 26 slips to allow the nut 25 to turn freely with the screw. Thus continual motor rotation does not apply any material downward force to the carriage 18. In FIG. 1 the arm 3 is shown in full lines at the upper limit of its travel, and in broken lines at the lower limit of its travel.

A collar 72 fixed to the tube 17 engages the top of the socket 13 to define the fully-inserted position of the column 2. Below the coupling member 39 shroud/deflector ring 78 surrounds the exposed portion of the output shaft 37, and an apertured guide plate 79 is fitted into the top end of the tube 19 of the carriage 18. A battery condition indicator meter 80 is fitted on the cover 57, and a shroud plate 81 is fitted around the gearbox 36.

I claim:

1. An invalid hoist comprising:

a base having a column support socket;

an upstanding column detachably mounted in said support socket, a screw-and-nut lifting mechanism extending longitudinally within said column, a lifting arm extending from the column and movable therealong by said lifting mechanism, the nut of said lifting mechanism being coupled to said lifting arm;

a reversible electric motor unit having an output shaft, a battery for energization of said motor unit, said motor unit and said battery being mounted on said base with said output shaft disposed in alignment with the screw of said mechanism; and a drive coupling positioned within said support socket for coupling the output shaft of said motor unit with said screw and comprising freely and axially separable lower and upper coupling elements, with said lower coupling element secured to said output shaft of the motor unit and said upper coupling element secured to a lower end of said screw of the lifting mechanism, the arrangement being such that said column is removable from said base by lifting out of said support socket without disturbing said motor unit.

2. An invalid hoist according to claim 2, wherein said drive coupling is of three-element type comprising said coupling elements and an intermediate spider member, said coupling members having interdigitated coupling dogs which are separated by arms of said intermediate spider member which said dogs engage, and said spider member being of resilient material to provide a cushioned drive.

3. An invalid hoist comprising:

a base having a hollow column support;

an upstanding column detachably mounted on said support, a screw-and-nut lifting mechanism within said column, a lifting arm extending from the column and movable therealong by said lifting mechanism, the nut of said lifting mechanism being coupled to said arm;

a reversible electric motor unit having an output shaft, a battery for energization of the motor unit, said motor unit and said battery being mounted on said base with said output shaft aligned with a lower end of the screw of said lifting mechanism; and a drive coupling for coupling the output shaft of said motor unit with the lower end of said screw to provide a drive from said motor unit to said screw, said drive coupling comprising axially separable lower and upper coupling elements with said lower coupling element fixed to said output shaft and said upper coupling element fixed to said lower end of the screw so that said column is readily liftable off of said base without disturbing said motor unit.

4. An invalid hoist according to claim 3, wherein an upper end bearing arrangement for the screw of said lifting mechanism is mounted within the column and incorporates an axial thrust bearing assembly which supports the weight of the lifting mechanism, the lifting arm and the weight supported by the latter, whereby said output shaft of the motor unit is relieved of axial loading.

5. An invalid hoist according to claim 3, wherein said lifting arm projects through a longitudinal slot in a front wall of the column and is attached to a wheeled carriage which runs inside the column so that the weight supported by the hoist does not apply a bending moment to the screw of said lifting mechanism.

6. An invalid hoist according to claim 5, wherein the column is formed of rectangular section steel tubing and said wheeled carriage has large diameter wheels engaging front and rear walls of the column which thus provide tracks along which the carriage is guided between the other side walls of the column, said longitudinal slot through which the lifting arm projects being formed in said front wall of the column.

7. An invalid hoist according to claim 5, wherein the nut of said lifting mechanism is embodied in a nut/-clutch unit fixed to the bottom of said wheeled carriage with the clutch of said nut/clutch unit operating rotationally to couple the nut to the carriage during raising movement thereof but allowing the nut to turn relative to the carriage, on a low friction bearing, and thus to turn with the screw in the event that lowering movement of the arm is obstructed.

8. An invalid hoist according to claim 3, wherein said base comprises a mobile chassis open at the front between longitudinal side members, said chassis having a rear cross member on which said mounting socket or spigot is centrally positioned with said motor unit being underslung with respect to the cross member.

9. An invalid hoist according to claim 8, wherein said cross member is of hollow rectangular box section and provides a battery housing into which said battery can be inserted from one end of the cross member which is open for this purpose.

10. An invalid hoist according to claim 9, wherein said battery is one of two batteries respectively mounted in and adjacent the two ends of the cross member both ends of which are left open for battery access.

11. An invalid hoist according to claim 8, wherein said motor unit comprises a reduction gear box providing said output shaft and which is positioned directly below said mounting socket or spigot, and said reversible electric motor which is secured to the gear box and extends laterally of the chassis below said cross member.

12. An invalid hoist according to claim 3, comprising a motor control circuit which includes operating relays respectively controlling lifting and lowering rotation of said reversible electric motor, and an upper limit switch operative to de-energized the motor when said arm reaches a predetermined upper limit of its travel, said limit switch being mounted on the base so that no wiring has to be disconnected when detaching said column from said base.

13. An invalid hoist according to claim 12, wherein said limit switch is actuated by an actuating rod running longitudinally through said column, said rod being spring loaded in one direction to an inoperative position in which the motor can be energised for further lifting movement of the arm and against which spring loading said actuating rod is mechanically moved when said arm reaches said upper limit of its travel with such movement actuating the limit switch to de-energise the motor.

14. An invalid hoist according to claim 12, wherein said control circuit operates to short circuit the motor and thus apply regenerative braking to the screw of said lifting mechanism at the end of each raising or lowering movement of said arm.

15. An invalid hoist according to claim 12, wherein said control circuit incorporates a hand-held RAISE/-LOWER/ON/OFF switch unit connected through a flexible lead.

16. An invalid hoist according to claim 3, wherein the upper end of the screw of said screw-and-nut mechanism is accessible and formed for engagement by a detachable winding handle, whereby said winding handle can be fitted for manual operation of the hoist in the event of an electrical failure.

17. An invalid hoist according to claim 3, wherein said base comprises a mobile base with side members each of which is supported on three wheels, said wheels comprising an intermediate fixed-axis wheel positioned forwardly of the center of gravity of the hoist with a patient supported thereby, a rear wheel of castor type and a front wheel, thereby providing the maneuverability of a short wheel base chassis with the stability of a long wheel base chassis which, while normally supported on the rear castor wheels, can rock forward on the intermediate wheels on to the front wheels.

18. An invalid hoist according to claim 17, wherein one of said intermediate wheels is of anti-static type, being electrically conductive and in electrical connection with the chassis.

19. An invalid hoist according to claim 3, wherein said drive coupling is positioned within said hollow column support.

* * * * *